US006105910A

United States Patent [19]

Roldan

[11] Patent Number: 6,105,910

[45] Date of Patent: Aug. 22, 2000

[54] MODEL VEHICLE TOY SUPPORT

[76] Inventor: Cesar A. Roldan, 20 Chaparral Dr., Pomona, Calif. 91766

[21] Appl. No.: 09/109,700

[22] Filed: Jul. 2, 1998

[51] Int. Cl.[7] ..... F16M 11/00

[52] U.S. Cl. ..... 248/176.1; 446/423

[58] Field of Search ..... 446/423, 128, 446/236, 448, 451, 465, 470; 248/176.1, 127, 146

[56] References Cited

U.S. PATENT DOCUMENTS

| | | | |
|---|---|---|---|
| 4,582,500 | 4/1986 | Hanson et al. | 446/423 |
| 4,767,375 | 8/1988 | Fassman | 446/423 |

*Primary Examiner*—Ramon O. Ramirez

[57] ABSTRACT

A model vehicle support is provided including a central frame having a lower portion and an upper portion with a plurality of clamps mounted thereon and extending upwardly therefrom. The upper portion of the central frame is connected to the lower portion via an elevation cylinder for allowing the frame of the model vehicle to be elevated.

16 Claims, 2 Drawing Sheets

MODEL VEHICLE TOY SUPPORT

BACKGROUND OF THE INVENTION

1. Field of the Invention

The present invention relates to model displays and more particularly pertains to a new model vehicle support for supporting a model vehicle.

2. Description of the Prior Art

The use of model displays is known in the prior art. More specifically, model displays heretofore devised and utilized are known to consist basically of familiar, expected and obvious structural configurations, notwithstanding the myriad of designs encompassed by the crowded prior art which have been developed for the fulfillment of countless objectives and requirements.

Known prior art model displays include U.S. Pat. No. 4,261,133; U.S. Pat. No. 5,397,260; U.S. Pat. No. 4,734,076; U.S. Pat. Des. 296,455; U.S. Pat. No. 4,356,657; and U.S. Pat. No. 5,015,210.

In these respects, the model vehicle support according to the present invention substantially departs from the conventional concepts and designs of the prior art, and in so doing provides an apparatus primarily developed for the purpose of supporting a model vehicle.

SUMMARY OF THE INVENTION

In view of the foregoing disadvantages inherent in the known types of model displays now present in the prior art, the present invention provides a new model vehicle support construction wherein the same can be utilized for supporting a model vehicle.

The general purpose of the present invention, which will be described subsequently in greater detail, is to provide a new model vehicle support apparatus and method which has many of the advantages of the model displays mentioned heretofore and many novel features that result in a new model vehicle support which is not anticipated, rendered obvious, suggested, or even implied by any of the prior art model displays, either alone or in any combination thereof.

To attain this, the present invention generally comprises a central frame with a lower portion having a rectangular configuration defined by a pair of side bars and a pair of end bars mounted therebetween. The central frame further includes an upper portion also having a rectangular configuration which is defined by a pair of side bars and a pair of end bars formed therebetween. The side bars of the upper portion each have a pair of clamps mounted thereon and extended upwardly therefrom adjacent to each end thereof. As shown in FIG. 1, each clamp includes a fixed vertical plate and a movable vertical plate screwably coupled to the fixed vertical plate. By this structure, a vertical slot is defined with an adjustable thickness to allow the mounting of a frame of a model vehicle thereon. For allowing the frame of the model vehicle to be elevated, the upper portion of the central frame is connected to the lower portion via an elevation means. Next provided is a plurality of platforms including a pair of loading platforms. Each loading platform includes a horizontal plate supported by a plurality of stanchions. A beveled plate is integrally coupled to the horizontal plate and depends therefrom. In use, the loading platforms are situated adjacent to the central frame at a first end thereof. The platforms further include a pair intermediate platforms each having a horizontal plate supported by a plurality of stanchions. A square cut out is formed in a side edge of the horizontal plate of each intermediate platform.

The intermediate platforms are situated adjacent to sides of the central frame. A pair of end platforms are also provided and each include a horizontal plate supported by a plurality of stanchions for being situated adjacent to a second end of the central frame. Together, the horizontal plates of the platforms are aligned to define a pair of parallel tracks which flank the central frame. Also included is a plurality of restraining arms each having a horizontally oriented portion with an inboard end pivotally coupled about a vertical axis to the central frame. Mounted on a bottom of the inboard end of the horizontal portion is a wheel assembly which is situated within the cut out of an associated one of the intermediate platforms. A vertically oriented portion has a lower end pivotally mounted about a horizontal axis to an outboard end of the horizontally oriented portion. A pivoting means is connected between the horizontally oriented portion and the vertically oriented portion for selectively pivoting the vertically oriented portion about the associated axis. As shown in FIG. 1, a chain has a first end mounted on a central extent of the vertically oriented arm and a second end with a hook for releasably connecting to the model vehicle.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new model vehicle support apparatus and method which has many of the advantages of the model displays mentioned heretofore and many novel features that result in a new model vehicle support which is not anticipated, rendered obvious, suggested, or even implied by any of the prior art model displays, either alone or in any combination thereof.

It is another object of the present invention to provide a new model vehicle support which may be easily and efficiently manufactured and marketed.

It is a further object of the present invention to provide a new model vehicle support which is of a durable and reliable construction.

An even further object of the present invention is to provide a new model vehicle support which is susceptible of a low cost of manufacture with regard to both materials and labor, and which accordingly is then susceptible of low prices of sale to the consuming public, thereby making such model vehicle support economically available to the buying public.

Still yet another object of the present invention is to provide a new model vehicle support which provides in the apparatuses and methods of the prior art some of the advantages thereof, while simultaneously overcoming some of the disadvantages normally associated therewith.

Still another object of the present invention is to provide a new model vehicle support for supporting a model vehicle.

Even still another object of the present invention is to provide a new model vehicle support that includes a central frame having a lower portion and an upper portion with a plurality of clamps mounted thereon and extending upwardly therefrom. The upper portion of the central frame is connected to the lower portion via an elevation cylinder for allowing the frame of the model vehicle to be elevated.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
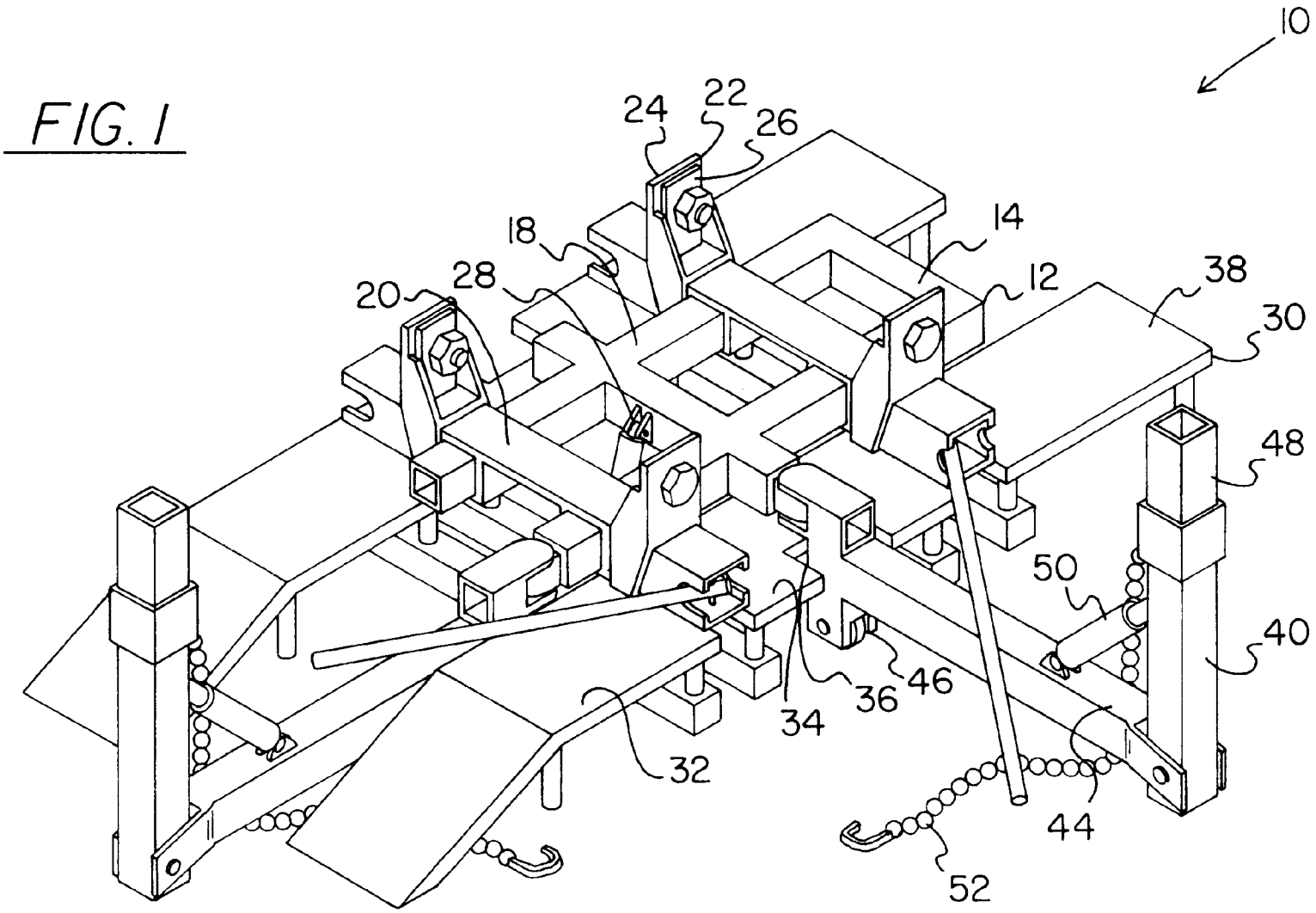
FIG. 1 is a perspective view of a new model vehicle support according to the present invention.
Figure 2:
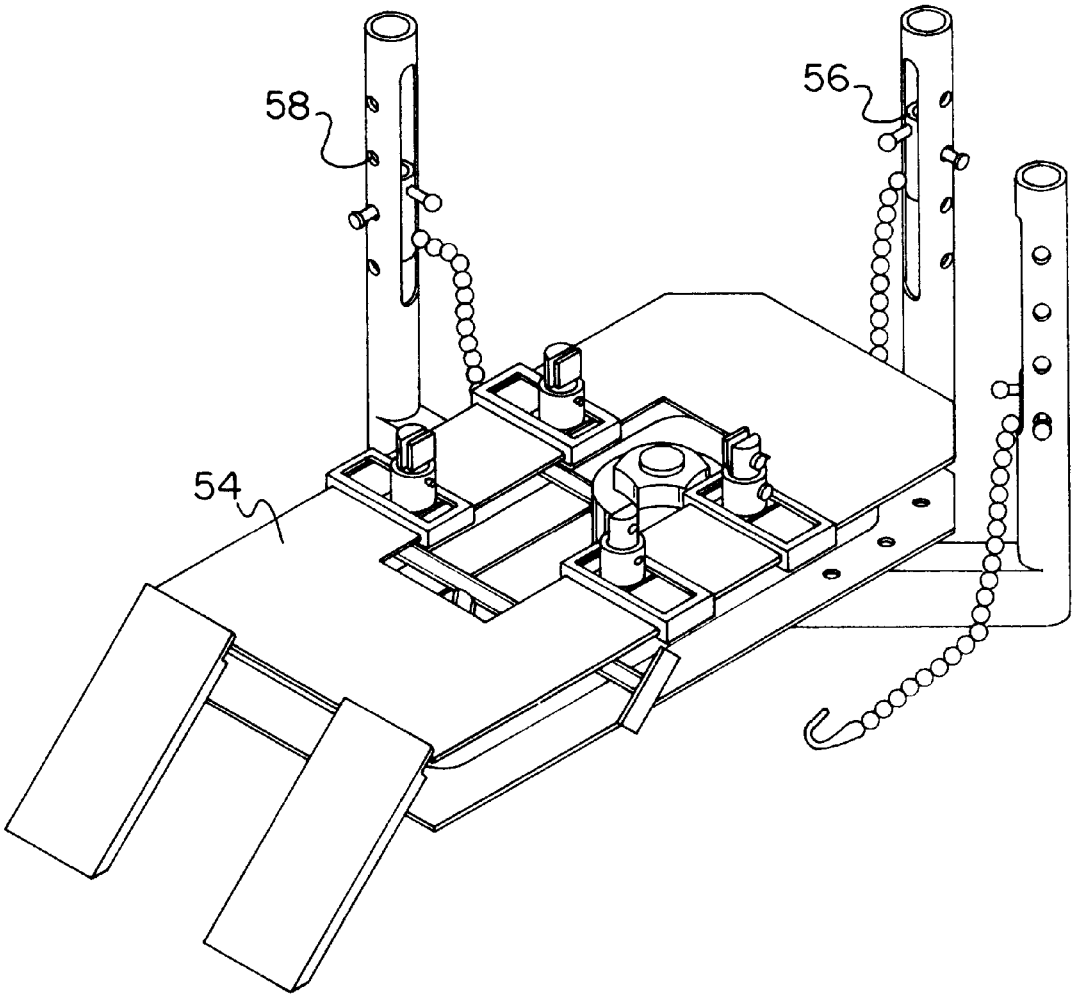
FIG. 2 is a perspective view of an alternate embodiment of the present invention.

With reference now to the drawings, and in particular to FIGS. 1 through 2 thereof, a new model vehicle support embodying the principles and concepts of the present invention and generally designated by the reference numeral 10 will be described.

The present invention, designated as numeral 10, includes a central frame 12 with an unillustrated lower portion having a rectangular configuration defined by a pair of side bars and a pair of end bars mounted therebetween. The central frame further includes an upper portion 14 also having a rectangular configuration which is also defined by a pair of side bars 18 and a pair of end bars 20 formed therebetween. Ideally, the central frame has a length of about 6 and ¼ inches, a width of about 2 and ⅜ inches and a height of about 2 inches.

The side bars of the upper portion each have a pair of clamps 22 mounted thereon and extended upwardly therefrom adjacent to each end thereof. As shown in FIG. 1, each clamp includes a fixed vertical plate 24 and a movable vertical plate 26 screwably coupled to the fixed vertical plate. By this structure, a vertical slot is defined with an adjustable thickness to allow the mounting of a frame of a model vehicle thereon. For allowing the model vehicle to be elevated, the upper portion of the central frame is connected to the lower portion via an elevation means. Such elevation means may take the form of at least one pneumatic cylinder 28 or any other means of elevating the upper portion in a stable manner. A hand pump may also be included for operating the pneumatic cylinder.

Next provided is a plurality of platforms 30 including a pair of loading platforms 32. Each loading platform includes a horizontal plate supported by a plurality of stanchions. A beveled plate is integrally coupled to the horizontal plate and depends therefrom. In use, the loading platforms are situated adjacent to the central frame at a first end thereof. The beveled plate has a length of about 6 inches.

The platforms further include a pair intermediate platforms 34 each having a horizontal plate supported by a plurality of stanchions. A square cut out 36 is formed in a side edge of the horizontal plate of each intermediate platform. The intermediate platforms are situated adjacent to sides of the central frame.

A pair of end platforms 38 are also provided and each include a horizontal plate supported by a plurality of stanchions for being situated adjacent to a second end of the central frame. Together, the horizontal plates of the platforms are aligned to define a pair of parallel tracks which flank the central frame. Each ramp has a width of about 1 and ½ inches. Together, the platforms and frame have a combined length of about 14 inches and a combined width of about 5 and ¼ inches.

Also included is a plurality of restraining arms 40 each having a horizontally oriented portion 44 with an inboard end pivotally coupled about a vertical axis to the central frame. Mounted on a bottom of the inboard end of the horizontal portion is a wheel assembly 46 which is situated within the cut out of an associated one of the intermediate platforms. A vertically oriented portion 48 has a lower end pivotally mounted about a horizontal axis to an outboard end of the horizontally oriented portion. The vertically oriented portion has a height of about 4 inches and the horizontally oriented portion has a length of about 5 and ½ inches. A pivoting means 50 is connected between the horizontally oriented portion and the vertically oriented portion for selectively pivoting the vertically oriented portion about the associated axis. The pivoting means preferably takes the form of a pneumatic cylinder similar to that of the elevation means. As shown in FIG. 1, a chain 52 has a first end mounted on a central extent of the vertically oriented arm and a second end with a hook for releasably connecting to the model vehicle. As shown in FIG. 1, a plurality of pivot members may be mounted on the frame for various purposes including maneuvering the present invention.

In an alternate embodiment, the upper and lower portions of the central frame take the form of a pair of planar plates 54. The frame of the alternate embodiment preferably has a length of about 12 inches, a width of about 6 inches and a height of about 2 and ¾ inches. Note FIG. 2. Further, the vertically oriented portion of each restraining arm has an insert 56 slidably situated therein for allowing the adjustment of a point at which the chains is coupled to the arm. Pin and aperture assemblies 58 are included for fixing the position of the insert within the associated restraining arm. It should be further noted that the restraining arms of the alternate embodiment are pivotally coupled to a central extent of the lower portion of the central frame. Further, such restraining arms each have a height of about 8 inches.

In use, a miniature model vehicle may be displayed on the central frame. Further, the present invention serves as a toy for children and adult model enthusiasts to simulate vehicle repair.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A model vehicle support comprising, in combination:

a central frame including a lower portion having a rectangular configuration defined by a pair of side bars and a pair of end bars mounted therebetween, the central frame further including an upper portion also having a rectangular configuration defined by a pair of side bars and a pair of end bars formed therebetween, the side bars of the upper portion each having a pair of clamps mounted thereon and extending upwardly therefrom adjacent to each end thereof, each clamp including a fixed vertical plate and a movable vertical plate screwably coupled to the fixed vertical plate for defining a vertical slot with an adjustable thickness to allow the mounting of a frame of a model vehicle thereon, wherein the upper portion of the central frame is connected to the lower portion via an elevation means for allowing the frame of the model vehicle to be elevated;

a plurality of platforms including a pair of loading platforms each including a horizontal plate supported by a plurality of stanchions and a beveled plate integrally coupled to the horizontal plate and depending downwardly therefrom wherein the loading platforms are situated adjacent to the central frame at a first end thereof, a pair intermediate platforms each including a horizontal plate supported by a plurality of stanchions and a square cut out formed in a side edge thereof wherein the intermediate platforms are situated adjacent to sides of the central frame, and a pair of end platforms each including a horizontal plate supported by a plurality of stanchions for being situated adjacent to a second end of the central frame, wherein the horizontal plates of the platforms are aligned to define a pair of parallel tracks which flank the central frame; and a plurality of restraining arms each including a horizontally oriented portion with an inboard end pivotally coupled about a vertical axis to the central frame, a wheel assembly mounted on a bottom of the inboard end of the horizontal portion and situated within the cut out of an associated one of the intermediate platforms, a vertically oriented portion having a lower end pivotally mounted about a horizontal axis to an outboard end of the horizontally oriented portion and extending upwardly therefrom, a pivoting means connected between the horizontally oriented portion and the vertically oriented portion for selectively pivoting the vertically oriented portion about the associated axis, and a chain having a first end mounted on a central extent of the vertically oriented arm and a second end with a hook for releasably connecting to the model vehicle.

2. A model vehicle support comprising:

a central frame including a lower portion and an upper portion having a plurality of clamps mounted thereon and extending upwardly therefrom, wherein the upper portion of the central frame is connected to the lower portion via an elevation means for allowing the frame of a model vehicle to be elevated; and a plurality of platforms removably situated adjacent to the central frame to define a pair of parallel tracks which flank the central frame.

3. The model vehicle support as set forth in claim 2 wherein each clamp includes a fixed vertical plate and a movable vertical plate screwably coupled to the fixed vertical plate for defining a vertical slot with an adjustable thickness to allow the mounting of a frame of a model vehicle thereon.

4. The model vehicle support as set forth in claim 2 wherein the platforms including a pair of loading platforms, a pair of intermediate platforms, and a pair of end platforms.

5. The model vehicle support as set forth in claim 2 and further including at least one restraining arm mounted on the central frame with a chain coupled thereto which is removably coupled to the model vehicle.

6. The model vehicle support as set forth in claim 5 wherein each arm has a wheel assembly mounted thereon.

7. The model vehicle support as set forth in claim 5 wherein each arm is hingably coupled to the central frame.

8. The model vehicle support as set forth in claim 5 wherein each arm includes a horizontal portion pivotally coupled to a vertical portion.

9. The model vehicle support as set forth in claim 8 wherein a point at which the chain is coupled to the vertical portion of the arm is adjustable along a height of the vertical portion.

10. A model vehicle support comprising:

a central frame including a lower portion and an upper portion having a plurality of clamps mounted thereon and extending upwardly therefrom, wherein the upper portion of the central frame is connected to the lower portion via an elevation means for allowing the frame of the model vehicle to be elevated; and at least one restraining arm mounted on the central frame with a chain coupled thereto which is removably coupled to the model vehicle.

11. The model vehicle support as set forth in claim 10 wherein each clamp includes a fixed vertical plate and a movable vertical plate screwably coupled to the fixed vertical plate for defining a vertical slot with an adjustable thickness to allow the mounting of a frame of a model vehicle thereon.

12. The model vehicle support as set forth in claim 10 wherein each arm is hingably coupled to the central frame.

13. The model vehicle support as set forth in claim 10 wherein each arm includes a horizontal portion pivotally coupled to a vertical portion.

14. The model vehicle support as set forth in claim 10 wherein each arm has a wheel assembly mounted thereon.

15. The model vehicle support as set forth in claim 13 wherein a point at which the chain is coupled to the vertical portion of the arm is adjustable along a height of the vertical portion.

16. The model vehicle support as set forth in claim 10 further including a pair of loading platforms, a pair of intermediate platforms, and a pair of end platforms.

* * * * *